US009909743B2

(12) United States Patent
Dankelmann et al.

(10) Patent No.: US 9,909,743 B2
(45) Date of Patent: Mar. 6, 2018

(54) CONNECTOR FOR LIGHT-EMITTING DIODE STRIP

(71) Applicant: Elemental LED, Inc., Emeryville, CA (US)

(72) Inventors: Andreas Dankelmann, San Francisco, CA (US); Mark D. Kelley, Oakland, CA (US)

(73) Assignee: Elemental LED, Inc., Reno, NV (US)

( * ) Notice: Subject to any disclaimer, the term of this patent is extended or adjusted under 35 U.S.C. 154(b) by 489 days.

(21) Appl. No.: 14/707,936

(22) Filed: May 8, 2015

(65) Prior Publication Data

US 2015/0241035 A1 Aug. 27, 2015

Related U.S. Application Data

(63) Continuation-in-part of application No. 13/967,017, filed on Aug. 14, 2013, now Pat. No. 9,239,136.

(51) Int. Cl.

| | |
|---|---|
| ***H01R 13/62*** | (2006.01) |
| ***F21V 21/005*** | (2006.01) |
| ***F21V 23/06*** | (2006.01) |
| ***F21S 4/28*** | (2016.01) |
| *H01R 25/16* | (2006.01) |
| *F21Y 103/10* | (2016.01) |
| *F21Y 115/10* | (2016.01) |

(52) U.S. Cl.
CPC ..... *F21V 21/005* (2013.01); *F21S 4/28* (2016.01); *F21V 23/06* (2013.01); *F21Y 2103/10* (2016.08); *F21Y 2115/10* (2016.08); *H01R 25/162* (2013.01)

(58) Field of Classification Search
CPC ..... F21V 23/06; H01R 13/62; H01R 13/6272; H01R 4/5066
See application file for complete search history.

(56) References Cited

U.S. PATENT DOCUMENTS

| | | | |
|---|---|---|---|
| 3,670,290 | A | 6/1972 | Angele et al. |
| 4,768,969 | A | 9/1988 | Bauer et al. |
| 4,952,177 | A | 8/1990 | Drake et al. |
| 5,848,837 | A | 12/1998 | Gustafson |

(Continued)

FOREIGN PATENT DOCUMENTS

| | | | |
|---|---|---|---|
| EP | 2078895 | B1 | 12/2012 |
| WO | 2013010445 | A1 | 1/2013 |

*Primary Examiner* — Andrew Coughlin
(74) *Attorney, Agent, or Firm* — Andrew McAleavey

(57) ABSTRACT

Embodiments of the invention relate to connectors for connecting strips of light-emitting diodes (LEDs) end-to-end and for connecting a single strip of LEDs to a power source. The connectors define a compartment to receive a strip of LEDs. Tabs extending inwardly from the sides of the connector retain the strip. Electrical contact with the strip is made by a pair of spring clip contacts that bear against electrical terminals on the strip. A hinged lid has an opening positioned so as not to obstruct the last LED on the strip, and carries a downwardly-facing block that bears against the spring clip ends to keep them in contact with the terminals of the strip. In a strip-to-power connector, the connector defines one compartment for each conductor, and each conductor carries connecting structure. Ends of the spring clip connectors carry complementary connecting structure.

21 Claims, 9 Drawing Sheets

(56) References Cited

U.S. PATENT DOCUMENTS

| | | | | |
|---|---|---|---|---|
| 6,283,612 | B1 | 9/2001 | Hunter | |
| 6,802,748 | B2 | 10/2004 | Wertz et al. | |
| 7,175,303 | B2 | 2/2007 | Kovacik et al. | |
| 7,473,006 | B1 | 1/2009 | Bollman | |
| 8,231,261 | B2 | 7/2012 | Gherardini et al. | |
| 8,297,788 | B2 | 10/2012 | Bishop | |
| 8,454,193 | B2 | 6/2013 | Simon et al. | |
| 8,714,772 | B1 | 5/2014 | Levante et al. | |
| 8,979,296 | B2 | 3/2015 | Wiemer et al. | |
| 9,206,964 | B2 | 12/2015 | Marsh et al. | |
| 9,374,856 | B2 | 6/2016 | Winton | |
| 2002/0106931 | A1 | 8/2002 | Hsien-Te | |
| 2004/0115984 | A1* | 6/2004 | Rudy | F21V 21/002 439/405 |
| 2005/0174808 | A1* | 8/2005 | Butsch | G01R 1/0416 362/652 |
| 2005/0215108 | A1 | 9/2005 | Chen | |
| 2005/0260874 | A1 | 11/2005 | Murakami et al. | |
| 2006/0197474 | A1* | 9/2006 | Olsen | H05B 33/0821 315/312 |
| 2009/0064571 | A1 | 3/2009 | Fakhari | |
| 2010/0008090 | A1 | 1/2010 | Li et al. | |
| 2012/0002417 | A1 | 1/2012 | Li | |
| 2012/0075863 | A1* | 3/2012 | Chen | F21V 21/002 362/249.18 |
| 2013/0249394 | A1 | 9/2013 | Fay | |
| 2015/0077998 | A1 | 3/2015 | Zhang | |
| 2015/0117005 | A1 | 4/2015 | Zanotto et al. | |
| 2015/0285472 | A1 | 10/2015 | Evitt | |

* cited by examiner

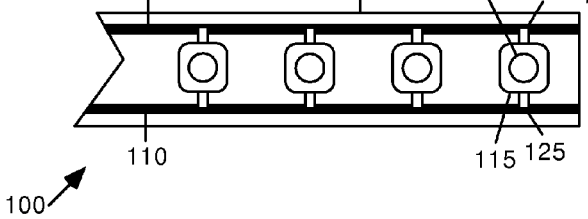
Fig. 1--Prior Art
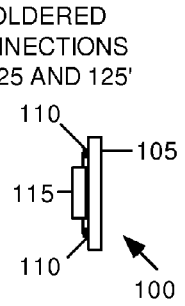
Fig. 2--Prior Art
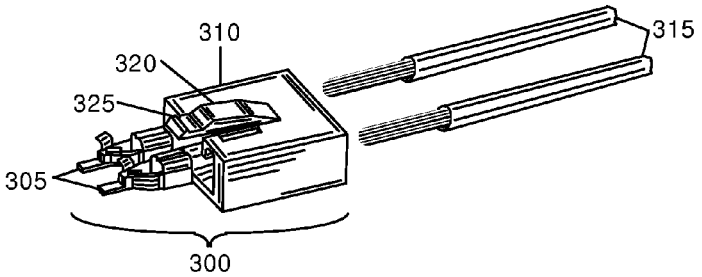
Fig. 3
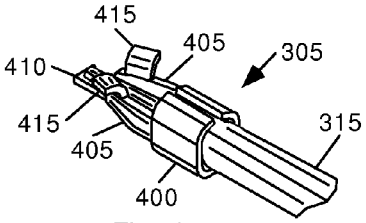
Fig. 4
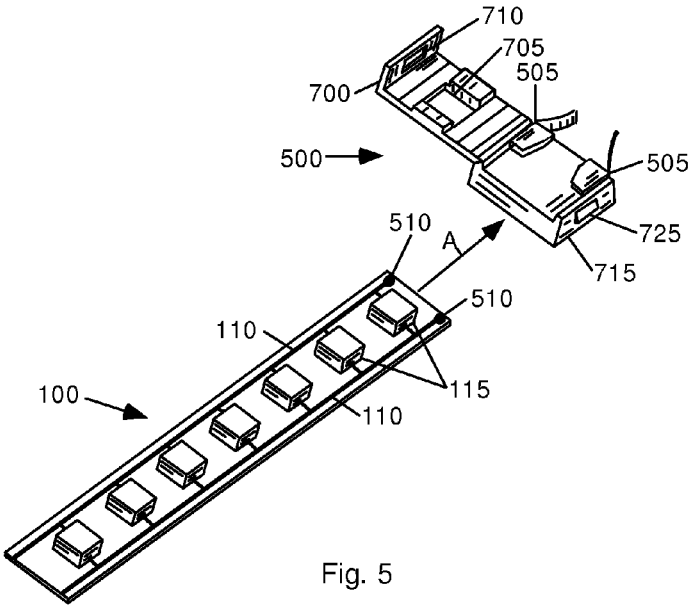
Fig. 5
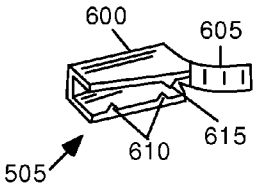
Fig. 6

CONNECTOR FOR LIGHT-EMITTING DIODE STRIP

CROSS-REFERENCE TO RELATED APPLICATIONS

This application is a continuation-in-part of U.S. patent application Ser. No. 13/967,017, filed Aug. 14, 2013. The contents of that application are incorporated by reference in their entirety.

BACKGROUND

Light-emitting diode (LED) lighting systems are in common use today. They offer improved electrical efficiency when compared with incandescent and fluorescent lighting. Individual LED lights are relatively small, ranging in size from a fraction of one millimeter for a single LED to an array of LEDs that is a square centimeter or more, comprising an array of smaller devices. Such lights incorporate lenses, reflectors, phosphors, and diffusers that influence the size, shape, and appearance of light output.

Prior-art LEDs are often sold in groups formed into a strip configuration that can have any length. These are often seen as flexible strands of lights used in holiday decorations, advertising, and emergency lighting. One such flexible strip configuration employs wire busses to which LEDs and a power source are connected.

Another prior-art strip configuration comprises conductors on one or more printed circuit boards (PCBs) to which are attached a plurality of LEDs, often by a well-known surface mount method.

In order to cause the LEDS on the strip to illuminate, power must be supplied to them from a power supply, which usually energizes pair of wires with a direct-current potential. These wires must be connected to the conductors on the PCB to supply operating current for the LEDs. Various connectors have been used and proposed to connect such wires to the PCB. The following is a list of some possibly relevant prior art that shows connectors for connecting wires to prior-art LED strip lighting systems. Following this list I provide a discussion of these references.

| Patent or Pub. Nr. | Kind Code | Issue or Pub. Date | Patentee or Applicant |
|---|---|---|---|
| U.S. Pat. No. 5,848,837 | B1 | Dec. 15, 1998 | Gustafson |
| U.S. Pat. No. 6,802,748 | B2 | Oct. 12, 2004 | Wertz et al. |
| US 2009/0064571 | A1 | Mar. 12, 2009 | Fakhari |
| EP 2078895 | B1 | Dec. 12, 2012 | Flashaar-Blooedorn |
| WO 2013/010445 | A1 | Jan. 24, 2013 | Yong Zhang |

Gustafson shows an integrally formed linear light strip with LEDs. The light strip is encapsulated between upper and lower thermoplastic extrusions. First and second bus elements are spaced apart and parallel to one-another on a printed circuit strip and LEDs are connected between the first and second bus elements. Connectors at the ends of his light strips connect to either a power source or to another light strip. The connectors are "metal connector pins heat-staked into the thermoplastic to contact the strip bus elements for interconnection of the light strips or for connection of light strips to the power source . . . " Gustafson also suggests using "conventional wiring means" or an electrical connector such as taught in U.S. Pat. No. 5,391,088 (to Tomchak, et al.) and used in lighting strips or surface wiring. The connector taught in this patent employs male pins that are crimped onto the ends of wires, are encased in an electrically conductive gel, and housed in a first rigid housing that mates with a second rigid housing with flat electrical conductors. "Conventional wiring means" implies the soldering or clamping together of conductors. The connectors taught in U.S. Pat. No. 5,391,088 must be urged together using at least one screw. None of these wiring means provides a quick-connect and quick-release feature simply joining the ends of conductors and the printed circuit portion of his light strip.

Wertz et al. show a three-point spring contact design used to connect varied electrical components to circuit boards. An elongated body has a long axis extending between a solderable portion at a first end and three spring contacts at a second end. The three spring contacts are urged against a single wire with the axis of the wire oriented perpendicularly to the long axis of the body. While this connector is useful for its intended purpose, its required orientation and method of connection to a wire renders it unsuitable as low-profile, flat connector to a PCB.

Fakhari shows an electrical conductor strip containing embedded wires. The strip is an elongated, flat ribbon. It is used as a lawn edging and is normally installed underground so that the top surface, i.e. the edge of the ribbon, faces upward. Lights are attached to the embedded wires using various means. Various means including wire nuts are used to join strips by joining their wires serially and to connect light sources such as LEDs to these wires. While this strip is useful it is also very bulky by nature, due to its outdoor placement at the lawn edge.

Flashaar-Blooedorn shows an LED light strip with a bus having a plurality of wires with self-healing insulation. The wires carry power for the LEDs and optionally also carry data for controlling the operation of the light strip. A plurality of pins connected to the light strip pierce the insulation on the wires and deliver power to the LEDs. A snap-on bridge connector joins LED strips. While this strip is useful, it is also bulky by nature since it contains a layer of wires underneath the LEDs.

Yong shows a piercing connector for a flexible LED light strip. Wires for supplying power to the LED strip are each terminated a piercing point. The piercing points are held in a fixture with a lid. The light strip is positioned in the fixture and the lid is closed, causing the piercing points to pierce conductors on the strip, thereby securing the strip to the connector.

SUMMARY OF THE INVENTION

We have discovered a method and apparatus that employs a plurality of electrically conductive pressure contacts to deliver power to a plurality of respective busses on a PCB strip having at least one LED attached. An openable and removable connector captures one or more LEDs when it is closed and attached to the PCB, thereby using the LED that was previously anchored to the PCB as an anchor. In a first aspect of a first embodiment, our connector comprises two parts: a first part provides a terminus for wires of different wire gauges that deliver power to the strip, and a second part that is anchored to at least one LED on the PCB removably captures the first part, thereby securely attaching the wires to the PCB strip without compromising or obscuring light output of the LED closest to the end of the PCB strip. In a second aspect, our connector provides electrically conductive pressure contacts that electrically join two PCB strips at their respective ends while securely anchoring itself to at least one LED located near the end of each strip without compromising or obscuring the light output of the LED's closest to the end of the strip.

In yet another aspect of the invention, a connector defines at least two compartments, including one compartment designed to receive a strip of LEDs. Tabs extend inwardly from the lateral sidewalls of the compartment to retain the strip of LEDs. A pair of electrical connecting members is attached to a central bridge between compartments and extends down into the compartment to make contact with electrical terminals on the strip of LEDs. The connector includes a lid connected to it by a hinge. The lid has an opening that is positioned so as not to obstruct the light from the first LED on the strip and includes a downwardly-projecting bar on its underside that is positioned to bear of the ends of the electrical connecting members to keep them in contact with the terminals.

In one embodiment according to this aspect of the invention, the connector defines a second compartment that is a mirror image of the first compartment and connects two strips of LEDs end-to-end. In another embodiment, the connector defines two compartments that are opposite the first compartment and are adjacent to one another. These additional compartments accept conductors with connecting structure on their ends. In this embodiment, ends of the connecting members form complementary connecting structure. Thus, this embodiment of the connector can connect a strip of LEDs to power.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the drawings, and in which:

FIGS. 1 and 2 show a prior-art LED light strip;

FIG. 3 is a perspective view of a power or wire connector portion that is ready for assembly;

FIG. 4 is a detail of a component of the connector of FIG. 3;

FIG. 5 is a perspective view of a LED connector portion assembly prior to assembly;

FIG. 6 is a perspective view of a component of the assembly in FIG. 5;

DETAILED DESCRIPTION

Prior Art Light Strip and Connector

Figure 7:
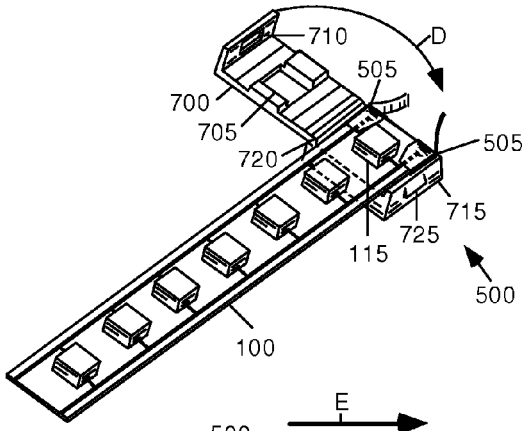
FIG. 7 is a perspective view of the components in FIG. 5, ready for assembly.

FIGS. 1 and 2 show a plan and end views, respectively, of one end of a prior-art PCB LED light strip 100. A light-strip board 105 is made of an insulating material, such as fiberglass, phenolic plastic, etc., that has printed conductors or busses 110 thereon. Conductors 110 extend down the length of strip 100, are typically made of copper, and are securely bonded to board 105 in well-known fashion.

The board has a row of LED assemblies, such as assembly 115, each having a central light-emitting portion 120 and at least two electrical connections 125. The LED assemblies are bonded to strip 100 using an adhesive compound (not shown) between the underneath surface of each assembly and board 105 and connections 125 are soldered to conductors 110 (FIG. 1), respectively, using well-known reflow soldering methods. The combination of the adhesive and solder bonds firmly secures the LED assemblies to board 105.

The semiconductor junctions that form the LEDs produce light when energized by a limited, direct-current potential source. Excessive currents or reverse potentials can cause failure of a device. Because of this, LED assemblies contain well-known current limiting circuitry, such as a resistor or current-limiting integrated circuit (not shown). If they are to be operated by an alternating current source, they also contain a rectifier (not shown) to prevent application of a reverse potential to the junction of the device.

The length of LED strip 100 can be short and include from one LED assembly 115 to several, or it can be very long and include many LED assemblies like assembly 115. In some applications a plurality of strips 100 are joined together, end-to-end.

In all applications, it is necessary to apply electrical power to conductors 110 on strip 100 in order to energize the LEDs. In the past, this was done by soldering wires to conductors 110. Wires from a power source (not shown) were soldered to conductors 110 and a plurality of strips 100 were electrically connected at their ends by soldering their respective conductors 110 together. While these connections worked, they were not easily disconnected. In addition, the spacing between assembly 115 at the end of a first strip 100 and a second assembly (not shown) at the beginning of a second strip (not shown) often would be different from the spacings of the remaining LED assemblies on each strip. This difference in spacing would call undesired attention to the joint between the first and second strips.

Connectors According to Embodiments of the Present Invention

FIG. 3 shows an exploded exterior perspective view of a power or wire connector portion or half 300 that can alleviate one or more of the above problems and that is ready for assembly. Wire connector half 300 of FIG. 3, together with a mating LED strip or anchor connector portion or half 500 (FIG. 5), are used to connect power supply wires 315 to strip of LEDs 100 (FIG. 5). I.e., wires 315 are connected to wire connector half 300 and LED strip 100 is connected to strip connector half 500, whereupon connector halves 300 and 500 can be connected together (mated) to connect the wires to the strip. This section discusses wire connector half 300 and its connection to wires 315 and the next section discusses strip connector half 500 and its connection to LED strip 100.

Wire connector half 300 has a housing 310 with a boxlike shape with a hollow interior and open left and right ends. A pair of wire-gripping terminals 305 are shown outside the left end but are assembled by securely molding them into housing 310. Wires 315 comprise a pair of wires with stripped ends; these are inserted into respective terminals 305 as described infra Housing 310 has a bendable tongue 320 with a raised tip 325 that extends upward from the top surface of housing 310. Tongue 320 can be inserted and removably locked into a recess in LED strip connector half 500, as discussed infra. Connector half 300 is made of an electrically insulating plastic such as nylon, polycarbonate, polypropylene, or acrylonitrile-butadiene-styrene (ABS) plastic.

FIG. 4 shows one of terminals 305 of connector half 300 with one of wires 315 installed. Each wire 315 comprises an electrical conductor such as copper that is surrounded with an electrically insulating material such as vinyl. Terminal 305 comprises a collar 400, two arms 405, and a contact tongue 410. Installation of wires 315 begins with the removal, or stripping, of insulation from the ends of wires 315 for a distance about equal to one half the length of terminal 305.

Wires 315 are then inserted through respective collars 400 until the stripped ends extend past the ends of arms 405 toward the distal end of contact tongue 410. Each of the wires or conductors in wires 315 is of sufficient diameter to springably urge arms 405 apart as each wire 315 is inserted into its terminal 305. Arms 405 pinch the conductor in each of wires 315 and therefore resist the removal of wires 315 by pulling from behind collar 400. Collar 400 is crimped securely against the insulation of wires 315 when added resistance to removal of these wires from terminal 305 is required. Terminal 305 is formed from a single, stamped piece of springable metal such as steel in well-known fashion. Terminal 305 can be either plated with a metal such as chromium or gold, or left as-is. On one realization of the connector the diameter of the group of conductors in each of wires 315 was about 1 mm, although other sizes can be used, depending upon the electrical current requirement of the LED strip. In lieu of a group of conductors, wires 315 can constitute a single conductor.

Arms 405 of terminal 305 further include a pair of curved wings 415 that are used in the removal of wire 315. When it is desired to remove wires 315 from terminal 305 wings 415 are displaced or pried apart by a lever such as the tip of a standard, flat-tipped cabinet screwdriver. A pair of slots 815 (FIG. 8) are provided for this purpose when terminal 305 is installed in connector half 300.

Figure 8:
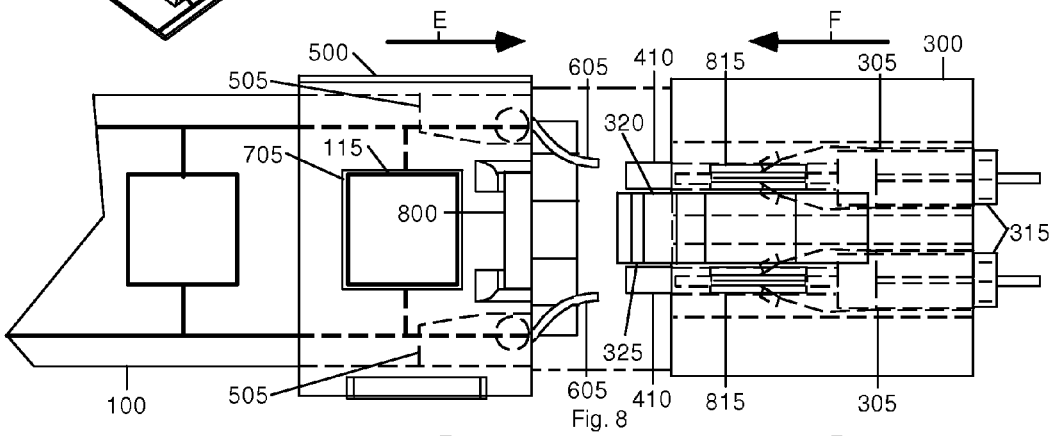
FIG. 8 is a plan view showing two components of a LED connector assembly ready to be joined.

The right side of FIG. 8 shows a plan view of connector half 300 assembled and ready to use. A pair of wires 315 are connected to terminals 305, which are in turn installed in housing 310 of connector half 300.

Connector and Anchor—FIG. 5 Through 7 and 8

FIGS. 5 through 7 show one aspect of anchor connector half 500 which is connected to or terminates LED strip 100 to enable strip 100 to be electrically connected to wire connector half 300 and hence wires 315 (FIG. 3).

FIG. 5 is a perspective view of LED connector and anchor half 500 which is used to connect to and hold strip 100. The busses or conductors 110 on strip 100 have solder bumps 510 at the ends of the strip to improve the electrical and mechanical contact to strip connector half 500.

Connector half 500 has a pair of spring clip electrodes 505 that are used to provide electrical contact to tongue 410 of collar 400, as described below. Electrodes 505 each have a channel shape and are mounted on connector half 500 so that the open sides of the channels face each other. Connector half 500 also includes a lid 700 with openings 705 and 710. Lid 700 is secured to body 715 by a "living" hinge 720 of flexible plastic material that is formed together with body 715 in well-known fashion. Alternatively, hinge 720 can be a standard "piano" hinge or other kind of hinge that hingedly joins lid 700 to body 715. Connector half 500 is formed by injection molding or another well-known method. FIG. 5 also shows LED strip 100, described supra.

FIG. 6 is a perspective view of one of spring clip electrodes 505 on connector half 500. Electrodes 505 comprise a channel-shaped body part 600. A curved arm 605 extends from one end of one side of the channel. One or more teeth 615 are provided at the inner, upper side of the channel of electrode 505 in order to provide secure electrical contact to buss 110. Additional teeth 610 are provided on the inner edge of the lower side of the channel to secure electrode 505 to board 110 when the two are joined (FIGS. 5 and 7). Electrodes 505 are formed of the same material as terminals 305. Electrodes 505 are secured within connector half 500 when it is molded. To assemble strip 100 and connector half 500, strip 100 is slidably engaged into the channels of electrodes 505 as indicated by arrow A. Teeth 615 in electrodes 505 (FIG. 6) engage conductors or busses 110 via solder bumps 510 (if present) and teeth 610 in engage the under-surface of strip 100 to secure strip 100 in electrodes 505.

FIG. 7 is a perspective view showing strip 100 and placed in electrodes 505 of connector half 500, ready for the closing of connector half 500. When lid 700 is closed (arrow D) opening 705 surrounds LED 115, thereby securing connector half 500 to strip 100. At the same time, a projection 725 on body 715 of connector half 500 slidably engages opening 710, thereby locking lid 700 in a closed position. After it has been locked, lid 700 can be opened by springably urging opening 710 away from projection 725 and raising lid 700. Although strip 100 and connector half 500 are secured together in part by the capture of LED 115, the light output of the first LED 115 on strip 100 is not obscured since LED 115 is fully exposed through opening 705.

The left side or FIG. 8 is a plan view of connector half 500 in a closed and locked condition showing LED 115 of strip 100 held securely in place within opening 705. The top of connector half 500 has a female socket 800 that receives and holds a spring catch or tongue 320 of connector half 300. The right side of FIG. 8 shows connector half 300, ready to be mated with connector half 500 as indicated by arrows E and F. Arms 605 of electrodes 505 are prepared to slidably contact tongues 410 of terminals 305.

Figure 9:
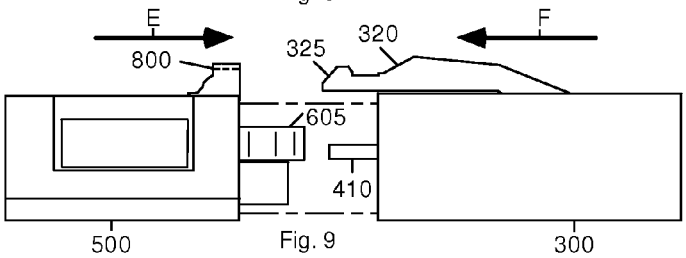
FIG. 9 is a side view of the components in FIG. 8.

FIG. 9 is a simplified side view of connector halves 300 and 500 prior to the joining of the two parts. Connector half 500 includes female socket 800 (FIGS. 8 and 9). Connector half 300 includes a tongue portion 320 with a tip portion 325 (FIGS. 8 and 9) that is sized to slidably enter socket 800 when connector halves 300 and 500 are urged together from the positions shown in FIGS. 8 and 9. Tongue 320 springably urges tip 325 upward so that when tip 325 enters socket 800 tip 325 will remain secured in socket 800 until tongue 320 is manually depressed. As also shown in FIG. 8, arms 605 of electrodes 505 are prepared to slidably contact tongues 410 of terminals 305.

Figure 10:
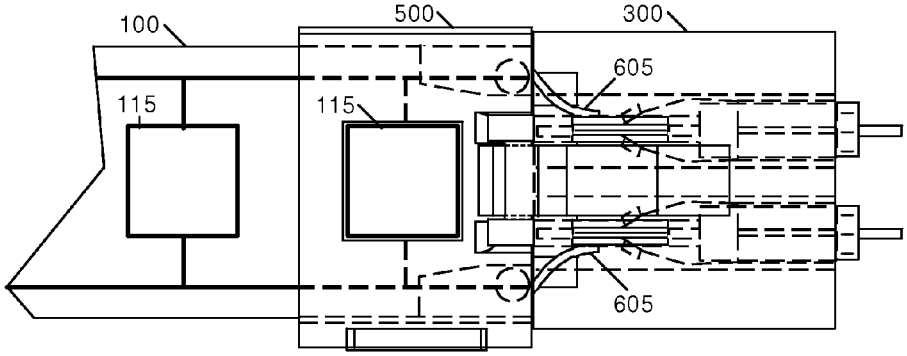
FIG. 10 is a plan view showing the two components of FIGS. 8 and 9 after they are connected.

Operation—First and Second Aspects of a First Embodiment are Joined—FIG. 10

FIG. 10 is a plan view showing the previously prepared connector halves 300 and 500 and their related components. Connector halves 300 and 500 have been urged together, as indicated by arrows E and F (FIGS. 8 and 9). Tip 325 of tongue 320 has springably and slidably entered socket 800 and is secured there by the upward spring force exerted by tongue 320, thereby securing the two housings together.

Arms 605 of electrodes 505 are springably urged against contact tongues 410 of terminals 305, making secure electrical contact between electrodes 505 and terminals 305. All components are now securely attached to one-another. LEDs 115 on strip 100 are ready for use and no portion of the light output of strip 100 is obscured by connector half 500.

Figure 11:
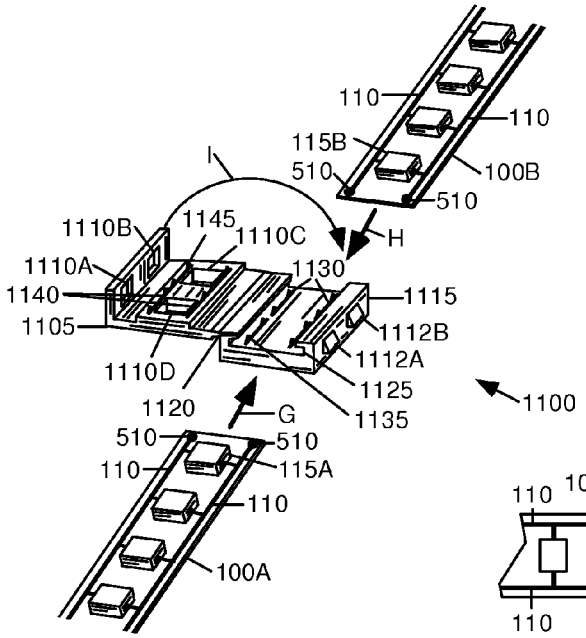
FIG. 11 is a perspective view of an alternate embodiment, ready for assembly.
Figure 12:
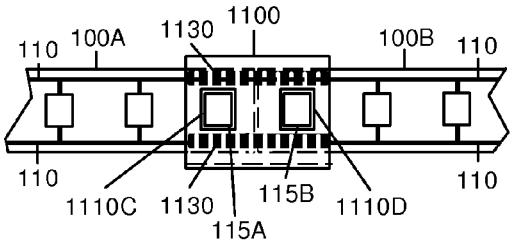
FIG. 12 is a plan view of the embodiment of FIG. 11 after assembly.

Description and Operation—Second Embodiment—FIGS. 11 and 12

FIG. 11 shows a perspective view of a second embodiment, here a connector for connecting two strips together. Specifically a connector 1100 is arranged to join and transferring power between two strips of LEDs 100A and 100B. Connector 1100 is constructed similarly to connector half 500. Connector 1100 comprises a lid 1105 and a body 1115 that are joined by a living hinge 1120 or piano hinge or other similar arrangement. Lid 1105 includes a plurality of openings 1110A, 1110B, 1110C, and 1110D.

Openings 1110A and 1110B removably mate with projections 1112A and 1112B when lid 1105 is closed, as indicated by arrow I.

Body 1115 further includes an open channel 1125. Channel 1125 further includes a plurality of gripping members 1130 on its lower surface. Members 1130 include a plurality of teeth 1135 and are made of metal or plastic. Strips 100A and 100B are installed in body 1115 by slidably urging them into channel 1125 as shown by arrows G and H, respectively. Teeth 1135 engage the lower side of strips 100A and 100B as the strips are urged into channel 1125. When they are fully inserted, strips 100A and 100B meet near the middle of body 1115 and LEDs 115A and 115B are located adjacent openings 1110D and 1110C, respectively.

Lid 1105 further includes a pair of electrodes 1140 with a plurality of teeth 1145. Electrodes 1140 are positioned so that when strips 100A and 100B have been installed and lid 1105 is closed, teeth 1145 will securely engage and connect solder bumps 510 and busses 110 on strips 100A and 100B.

FIG. 12 is a plan view showing strips 100A and 100B properly installed in connector 1100. Openings 1110A and 1110B have springably and removably engaged projections 1112A and 1112B (FIG. 11), respectively so that connector 1100 is securely closed. Conductive members 1130 and teeth 1135 have been firmly urged against and connected busses 110, and LEDs 115 A and 115B are secured within openings 1110C and 1110D, respectively.

Connector 1100 is molded and made of the same material as connector halves 300 and 500, although other materials can be used. Members 1130 and electrodes 1140 are made of a sturdy, electrically conductive metal such as steel, copper, brass, or another material, although members 1130 can be made of another, electrically non-conductive material. They are installed in connector 1100 either at the time of molding, or they can be installed at a later time.

Additional Embodiments

Figure 13:
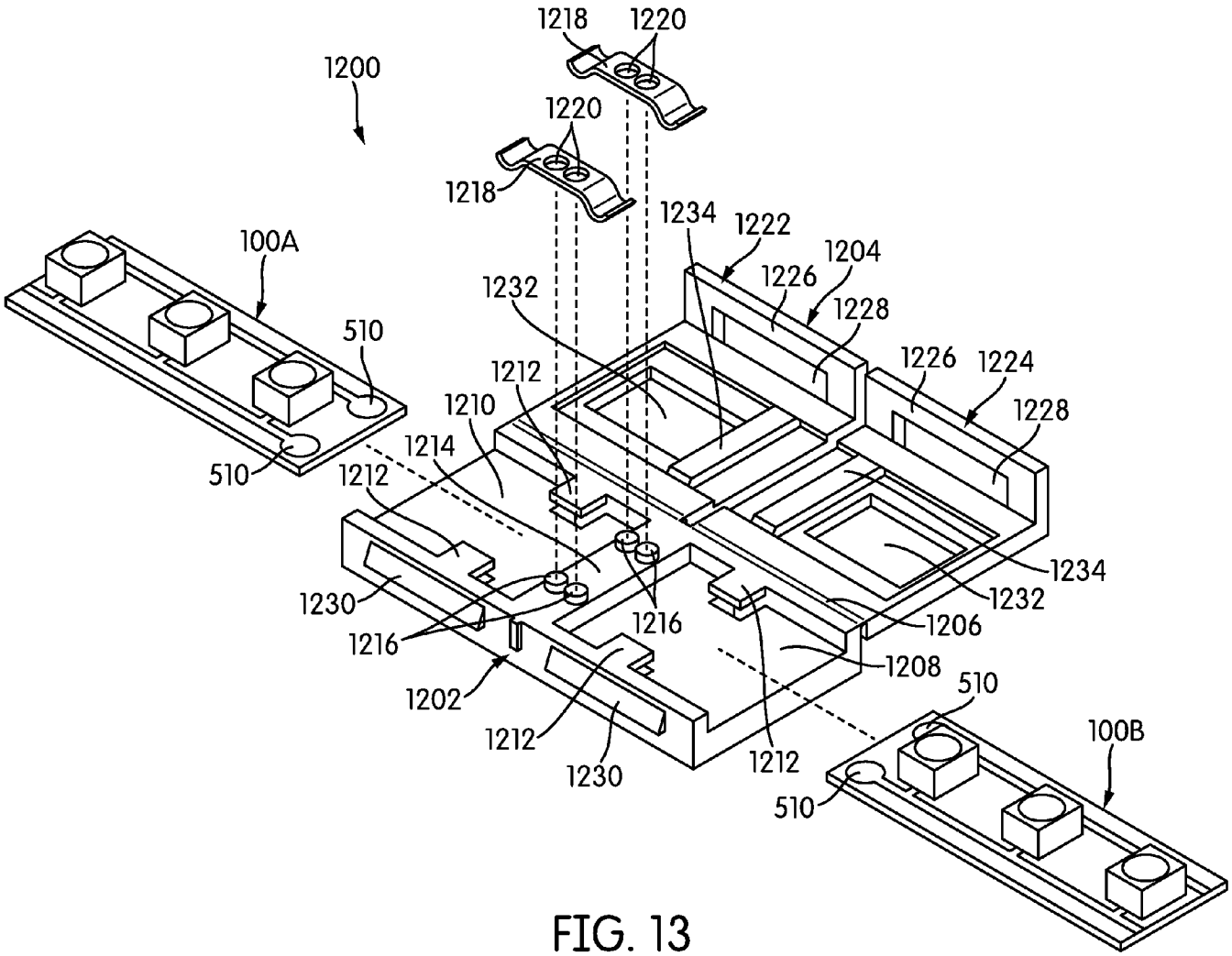
FIG. 13 is a perspective view of a strip-to-strip connector according to another embodiment of the invention.

FIG. 13 is an exploded perspective view of a connector 1200 according to another embodiment of the invention, shown as joining two strips of LEDs 100A and 100B. As compared with connectors 500, 1100 according to previous embodiments, the connector 1200 has different, and more easily connectable, structure for connecting and retaining the two strips of LEDs 100A and 100B.

The connector 1200 itself has a body 1202 that is connected to a lid 1204 by a living hinge 1206, and may be made of the same types of non-conductive materials as the other connectors 500, 1100. The body 1202 defines two compartments 1208, 1210, one for each of the strips of LEDs 100A, 100B that are to be connected. Two tabs 1212 extend into each compartment 1208, 1210, one from each sidewall, at a height just greater than the thickness of the strips of LEDs 100A, 100B, thus creating a partial slot between the floor of the compartment 1208, 1210 and the tabs 1212 and helping to retain the two strips of LEDs 100A, 100B in their respective compartments 1208, 1210. A raised central piece or bridge 1214 extends between the two compartments 1208, 1210 and defines their inner wall.

Two pairs of generally cylindrical, upwardly-extending pegs 1216, made of an electrically insulative material, arise from the central piece 1214 and seat two spring clips 1218 with complementary openings 1220. The fit between the pegs 1216 and the openings 1220 is preferably tight. The spring clips 1218 extend into the two compartments 1208, 1210 and have sufficient length to contact the respective terminals 1222 of the strips of LEDs 100A, 100B when the strips 100A, 100B are in the connector 1200, are made of an electrically conductive material, and serve to place the two strips of LEDs 100A, 100B in electrical contact with one another.

While two pairs of pegs 1216 are shown in the illustrated embodiment, in some embodiments, due to size and other considerations, a single, larger peg may be used instead of a pair of pegs 1216. In some cases, the structure that seats and connects the spring clips 1218 on the central piece 1214 may not be a peg, but rather, a structure with a more specific shape.

Figure 14:
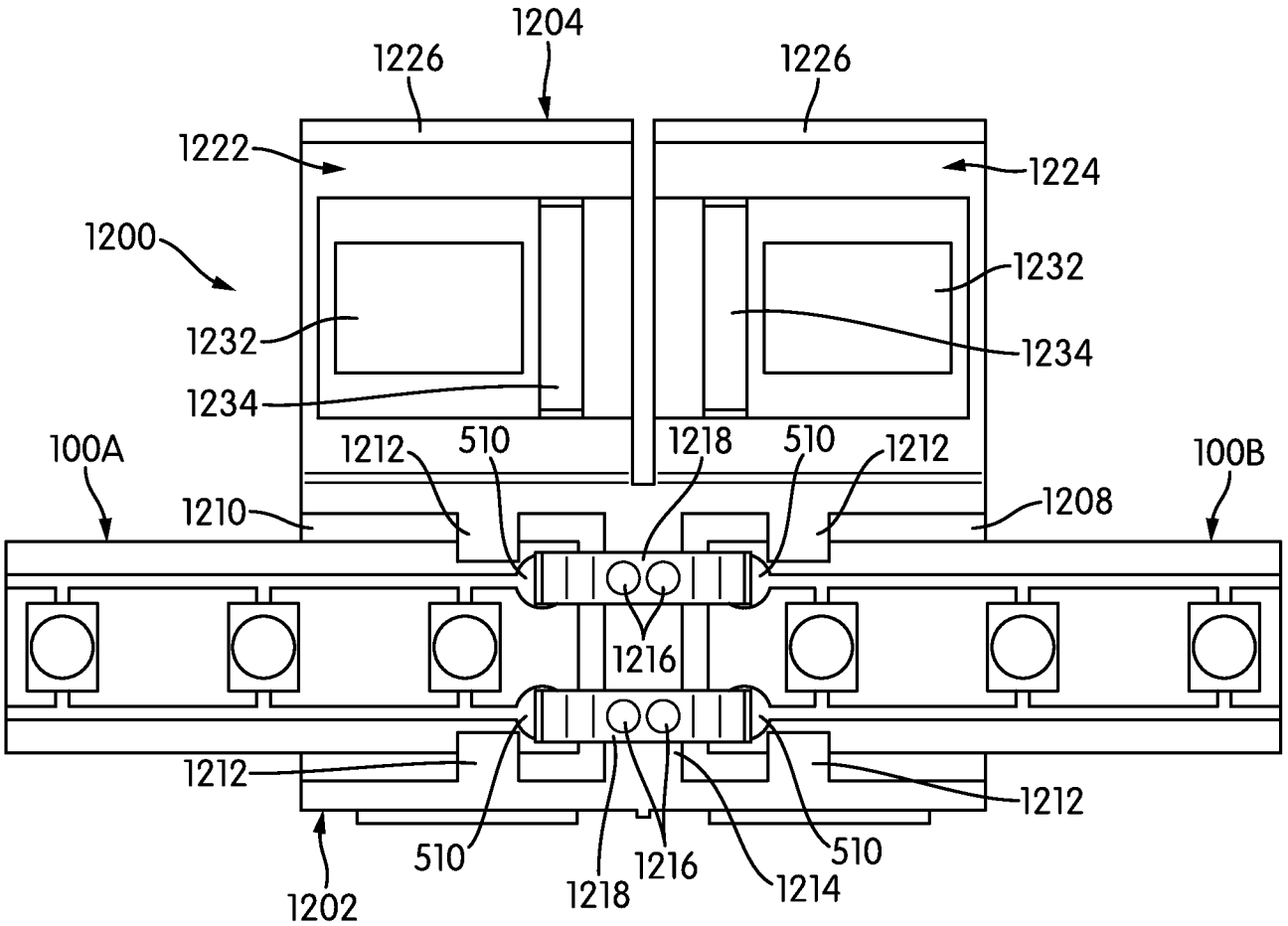
FIG. 14 is a top plan view of the connector of FIG. 13 with its lid open.

FIG. 14 is a top plan view of the connector 1200, showing the two strips of LEDs 100A, 100B in the connector 1200. The installer slides the two strips of LEDs 100A, 100B into the connector 1200, where they are retained by the tabs 1212. The spring clips 1218 insert over the pegs 1216, contact the terminals 510, and also mechanically secure the two strips of LEDs 100A, 100B in the connector 1200.

In the illustrated embodiment, the lid 1204 actually has two halves 1222, 1224 that are mirror images of one another and that move independently of one another. Each half 1222, 1224 has a depending flange 1226 that defines an opening 1228. On the side of the base 1202, a set of wedges 1230 is provided in a position to complement and engage the openings 1228, such that when the halves 1222, 1224 of the lid 1204 are closed, the flanges 1226 slide over the wedges 1230 and engage them within the openings 1230 to secure the lid 1204 in place.

Figure 15:
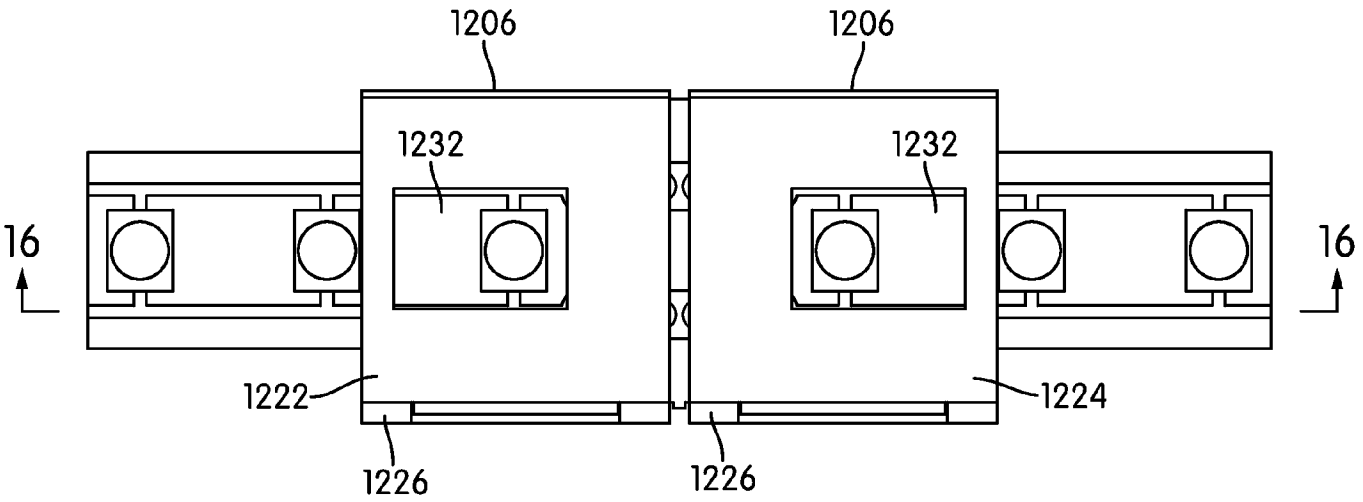
FIG. 15 is a top plan view of the connector of FIG. 13 with its lid closed.

FIG. 15 is a top plan view of the connector 1200 with the lid 1204 closed over the two strips of LEDs 100A, 100B. As shown in FIG. 15, windows 1232 in the lid 1204 are positioned and dimensioned so as to expose and not obstruct the light from the first LEDs in the strips 100A, 100B. The connector 1200 as a whole is also dimensioned such that it terminates just before the second LED in the strip 100A, 100B, so it does not obstruct that LED either. In fact, while the illustrated embodiment shows four-sided windows 1232, the windows 1232 may be of any shape. In particular, in the illustrated embodiment, the strips of LEDs 100A, 100B have rectangular LED assemblies; however, the LED assemblies may be of any shape, and the windows 1232 may match that shape.

Figure 16:
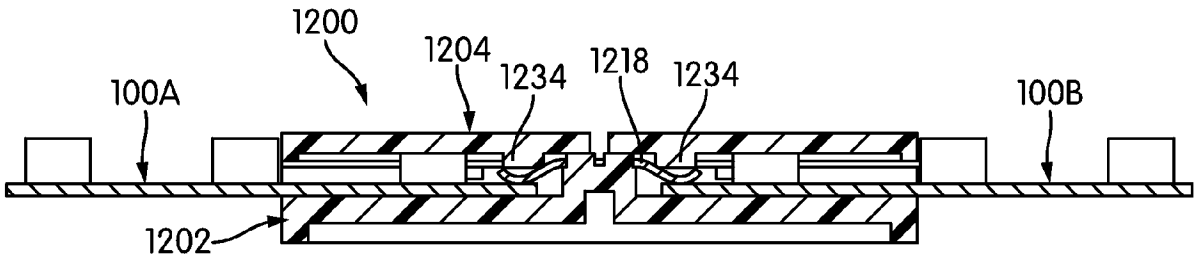
FIG. 16 is a cross-sectional view taken through Line 16-16 of FIG. 15.

The lid 1204 also includes other features that to secure the strips of LEDs 100A, 100B mechanically within the connector 1200. More specifically, each half 1222, 1224 of the lid 1204 has a downwardly-projecting bar 1234 on its underside. FIG. 16 is a cross-sectional view of the connector 1200, taken through Line 16-16 of FIG. 15. As can be seen in FIG. 16, when the lid 1204 is closed, the bars 1234 on the underside of the lid 1204 bear down on the spring clips 1218, keeping them in place. While the windows 1232 in illustrated embodiment of the lid 1204 are shown as being four-sided, the edge that faces the strip of LEDs 100A, 100B may simply be omitted, leaving windows 1232 that are essentially U-shaped cut-outs in the lid.

Figure 17:
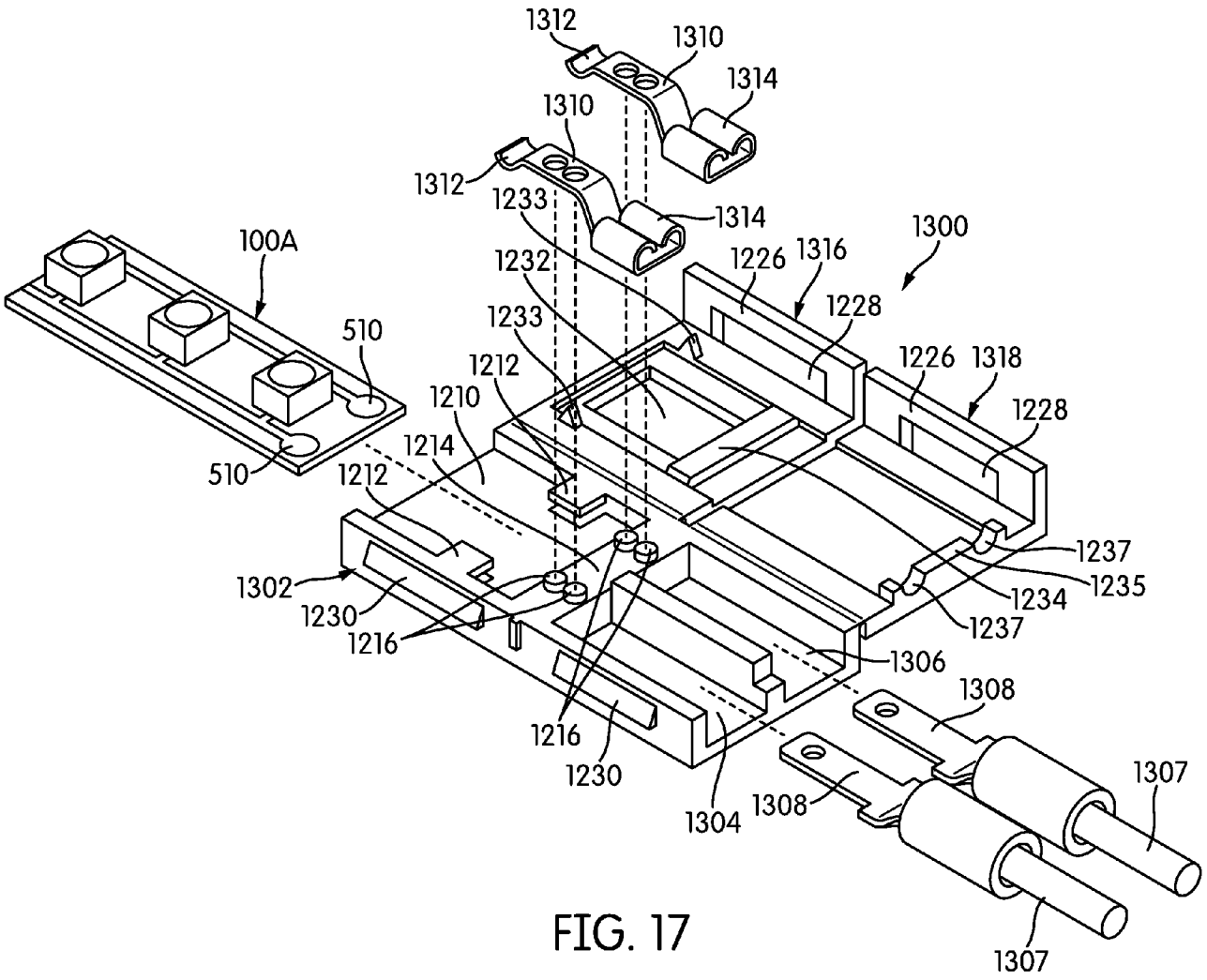
FIG. 17 is a perspective view of a strip-to-power connector according to yet another embodiment of the invention.

The connector 1200 of FIGS. 13-16 is used to connect two strips of LEDs 100A, 100B. FIG. 17 is a perspective view of a connector 1300 that has the same features and advantages of connector 1200 with respect to connecting to a strip of LEDs 100A but also has advantages for connecting to a power source. As shown in FIG. 17, like connector 1200, the base 1302 of connector 1300 includes three compartments. One compartment 1210 is substantially identical to the compartments 1208, 1210 of connector 1200 and secures the strip of LEDs 100A. The description above will suffice to describe similar components in that compartment. The other side of the connector 1300 is divided into two compartments 1304, 1306.

Instead of receiving bare wire conductors, with connector 1300, the conductors 1307 are encased in standard spaded male connectors 1308. In connector 1300, instead of bilateral spring clips 1218, connector 1300 has a set of electrical contact members 1310. One end 1312 of each of these contact members 1310 is shaped as a spring clip and makes contact with the terminals 510 of the strip of LEDs 100A. The other end 1314 of each contact member 1310 comprises female connecting structure complementary to the spaded connectors 1308, and extends downwardly into the compartments 1304, 1306. Thus, when the contact members 1310 are secured on the pins 1216, the spaded male connectors 1308 insert into respective compartments and into the complementary female conducting structure 1314 found there.

Figure 18:
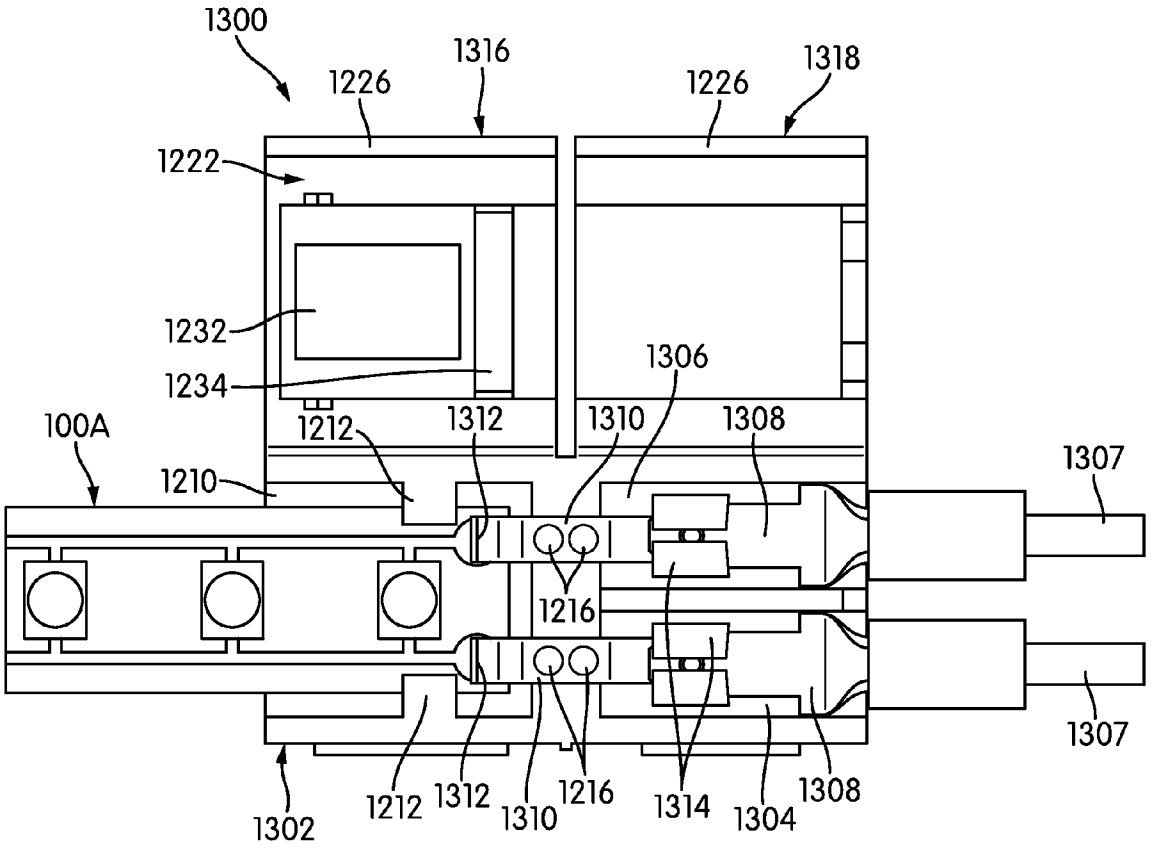
FIG. 18 is a top plan view of the connector of FIG. 17 with its lid open.
Figure 19:
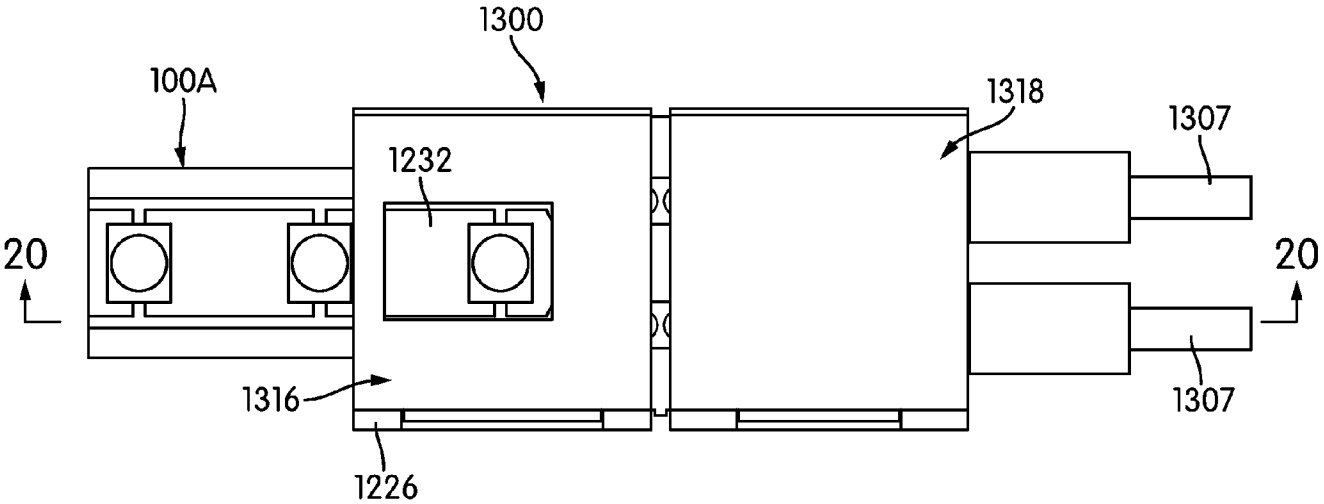
FIG. 19 is a top plan view of the connector of FIG. 17 with its lid closed.

FIG. 18 is a top plan view of connector 1300 with both the spaded connectors 1308 of the power conductors 1307 and the strip of LEDs 100A installed. In the view of FIG. 18, the lids 1316, 1318 of the connector 1300 are open; FIG. 19 is a top plan view of connector 1300 with the lids 1316, 1318 closed. As shown in the figures, the two lids 1316, 1318 are different. The lid 1316 over the compartment 1210 is similar to the half-lid 1222 of connector 1200. The lid 1318 has essentially the same functional features as the lid 1316, and in particular, engages with the body 1302 of connector 1300 in the same way; however, it is closed and has no windows or openings.

While the lids 1316, 1318 are similar to lids according to previous embodiments of the invention, both of them illustrate optional mechanical features that may be used to better retain the strip of LEDs 100A and the two power conductors 1307 in the respective compartments 1302, 1304, 1306. More specifically, the lid 1316 has two downwardly-projecting triangular points 1233 that bear on the strip of LEDs 100A and exert force when the lid 1316 is closed to keep the strip of LEDs 100A in place. By the same principle, the outward edge of the lid 1318 has a bar 1235 with semicircular cut-outs 1237 that are sized and positioned to fit over and bear on the two power conductors 1307. When the lid 1318 is closed, the bar 1235 bears on the conductors and helps to retain them in the compartments 1304, 1306. In general, connectors according to embodiments of the invention may have any number or type of features intended to help secure the components within the connector.

Figure 20:
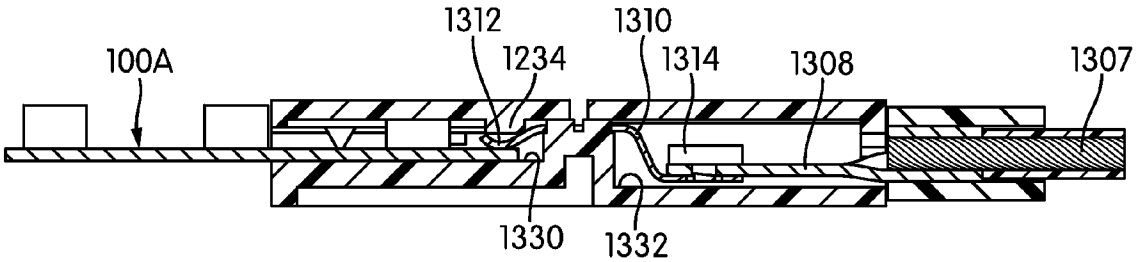
FIG. 20 is a cross-sectional view taken through Line 20-20 of FIG. 17.

FIG. 20 is a cross-sectional view taken through Line 20-20 of FIG. 19, illustrating the structures within the connector, and in particular, how the female connecting structure 1314 of the contact member 1310 sits proximate to the base 1302. As is also shown in FIG. 20, the body 1302 of connector 1300 may have various internal contours such that the floor 1330 of the compartment 1210 and the floor 1332 of the two compartments 1304, 1306 provided for the conductors 1307 are set at different levels. This is done so that the components received in the connector will be at the same level despite different thicknesses.

Conclusions, Ramifications, and Scope

The present method and apparatus securely electrically and mechanically connects a LED strip to a power source connector and also permits the secure electrical and mechanical joining of two LED strips without the need for soldering. In various aspects it has one or more of the following advantages: the ability to make and release connections faster, the provision of a low-profile, flat connector for a PCB, and the provision of a compact connector.

While the above description contains many specificities, these should not be construed as limitations on the scope, but as exemplifications of some present embodiments. Many other ramifications and variations are possible using the system and methods described. For example, round LEDs can be used instead of square, with round openings in the lids of the LED holders. Mounting holes can be included in the bases of the LED holders so that fasteners can be used to secure the connectors to a surface. Adhesive can be applied to the underneath surface of the LED holders so that they can be secured to a surface. Different widths and sizes of LEDs and different wire gauges and conductor widths and thicknesses can be used. The holders can be supplied in any color. Instead of a hinge joining the cover and the base, a snap-on cover or two-piece can be provided.

Thus the scope should be determined by the appended claims and their legal equivalents, rather than the examples and particulars given.

What is claimed is:

1. A connector, comprising:

a connector base comprised of an electrically insulative material, the connector base defining at least two compartments, a first compartment of the at least two compartments having a pair of retaining tabs extending into the compartment from respective sidewalls thereof and creating a slot between a floor of the first compartment and the pair of retaining tabs, a barrier between the first compartment and others of the at least two compartments, one or more conductive connecting members mounted on the barrier and extending between the first compartment and the others of the at least two compartments, and lid-engaging structure; and a lid connected to the connector base by a hinge, the lid having complementary structure to engage the lid-engaging structure on the connector base.

2. The connector of claim 1, wherein the lid includes a downwardly-extending bar positioned and adapted to exert pressure on contact ends of the one or more connecting members when the lid is closed.

3. The connector of claim 1, further comprising a second compartment of the at least two compartments disposed opposite the first compartment across the barrier, such that the first compartment and the second compartment are in-line with one another.

4. The connector of claim 3, wherein the one or more connecting members have first ends extending downwardly into the first compartment to make contact with a first set of terminals inserted into the first compartment and second sends extending downwardly into the second compartment to make contact with a second set of terminals inserted into the second compartment.

5. The connector of claim 1, further comprising third and fourth compartments of the at least two compartments, the third and fourth compartments being adjacent to one another across the barrier from the first compartment, each of the third and fourth compartments being sized to accept a power conductor with a connector attached thereto.

6. The connector of claim 5, wherein the one or more conductive connecting members have first ends adapted to contact and bear against electrical terminals and second ends carrying complementary connecting structure for connecting to the connectors of the power conductors.

7. The connector of claim 5, wherein a floor of the first compartment and a floor of the third and fourth compartments are set at different levels.

8. The connector of claim 1, wherein the lid has at least one opening therein.

9. The connector of claim 1, wherein the connector is molded from a plastic.

10. The connector of claim 9, wherein the plastic is selected from the group consisting of nylon, polycarbonate, polypropylene, and acrylonitrile-butadiene-styrene (ABS) plastic.

11. A connector, comprising:

a connector base comprised of an electrically insulative material, the connector base defining first and second compartments opposite and in-line with one another with a barrier therebetween, each of the first and second compartments having a pair of retaining tabs extending into the compartment from respective sidewalls thereof and creating a slot between a floor and the pair of retaining tabs, one or more conductive connecting members mounted on the barrier and extending between the first and second compartments with ends that extend into the respective compartments to contact electrical terminals placed in the first and second compartments, and lid-engaging structure; and a lid connected to the connector base by a hinge, the lid having complementary structure to engage the lid-engaging structure on the connector base.

12. The connector of claim 11, wherein the lid includes a downwardly-extending bar positioned and adapted to exert pressure on contact ends of the one or more connecting members when the lid is closed.

13. The connector of claim 11, wherein the lid includes a first opening positioned over the first compartment and a second opening positioned over the second compartment.

14. The connector of claim 11, wherein the connector is molded from a plastic.

15. The connector of claim 14, wherein the plastic is selected from the group consisting of nylon, polycarbonate, polypropylene, and acrylonitrile-butadiene-styrene (ABS) plastic.

16. In combination:

a light-emitting diode (LED) strip comprising a substrate having a plurality of LED assemblies thereon, the LED assemblies being electrically connected to one another and being arranged at regular intervals along the strip, the plurality of LED assemblies including a terminal LED assembly at one end of the LED strip in proximity to a set of electrical contacts; and a connector, comprising a connector base comprised of an electrically insulative material, the connector base defining at least two compartments, a first compartment of the at least two compartments having a pair of retaining tabs extending into the compartment from respective sidewalls thereof and creating a slot between a floor of the first compartment and the pair of retaining tabs, the slot receiving the end of the LED strip proximate to the terminal LED assembly and the set of electrical contacts such that the electrical contacts are within the first compartment, a barrier between the first compartment and others of the at least two compartments, one or more conductive connecting members mounted on the barrier and extending between the first compartment and the others of the at least two compartments, and lid-engaging structure, and a lid connected to the connector base by a hinge, the lid having complementary structure to engage the lid-engaging structure on the connector base, the lid having an opening therein positioned such that the lid does not obstruct the terminal LED.

17. The combination of claim 16, wherein the lid includes a downwardly-extending bar positioned and adapted to exert pressure on contact ends of the one or more connecting members when the lid is closed.

18. The combination of claim 16, wherein the connector base further comprises a second compartment adjacent to and in-line with the first compartment, the second compartment being a mirror image of the first compartment and being adapted to accept a second strip of LEDs, such that the connecting members place the two strips of LEDs in electrical communication with one another.

19. The combination of claim 16, wherein the connector base further comprises third and fourth compartments, each of the third and fourth compartments being sized and adapted to accept a conductor with connecting structure; and wherein ends of the connecting members carry receiving structure complementary to the connecting structure.

20. The combination of claim 16, wherein the connector is made of a plastic.

21. A connector, comprising:

a connector base defining at least two compartments, a first compartment of the at least two compartments having a pair of retaining tabs extending into the compartment from respective sidewalls thereof and creating a slot between a floor of the first compartment and the pair of retaining tabs, a barrier between the first compartment and others of the at least two compartments, one or more conductive connecting members extending between the first compartment and the others of the at least two compartments, and lid-engaging structure; and a lid connected to the connector base by a hinge, the lid having complementary structure to engage the lid-engaging structure on the connector base.

* * * * *